United States Patent [19]

Cavagna

[11] Patent Number: 4,649,782

[45] Date of Patent: Mar. 17, 1987

[54] CUTTING UNITS FOR CUTTING MATERIAL IN BANDS INTO STRIPS

[76] Inventor: Elio Cavagna, P.zza Piemonte 5, Melegnano, Italy

[21] Appl. No.: 661,573

[22] Filed: Oct. 16, 1984

[30] Foreign Application Priority Data

Nov. 8, 1983 [IT] Italy ..... 23635 A/83

[51] Int. Cl.[4] ..... B26D 1/24

[52] U.S. Cl. ..... 83/425.4; 83/499; 83/481

[58] Field of Search ..... 83/499, 425.4, 504, 83/481, 549

[56] References Cited

U.S. PATENT DOCUMENTS 3,646,418 2/1972 Sterns et al. ..... 83/499 X
4,033,217 7/1977 Flaum et al. ..... 83/499 X
4,316,317 2/1982 Ritzling ..... 83/499 X

*Primary Examiner*—Donald R. Schran
*Attorney, Agent, or Firm*—Bucknam and Archer

[57] ABSTRACT

Improved cutting unit for cutting material in bands into strips comprising a rotating blade and counter-blade, carried on their respective supports and translatable along at least one beam of the framework, in which a single pressurized fluid pipe enables the blade-carrying support to be locked on the beam and simultaneously, the two supports released; or alternatively, the blade-bearing support to be unlocked and simultaneously the counter-blade support connected to the blade-carrying one. The lockings and connections are obtained by means of pneumatic pistons placed laterally and in the lower part of the blade-carrying support. The counter-blade consists of two elements fixed together and separated by a centerpiece.

9 Claims, 7 Drawing Figures

BEST AVAILABLE COPY
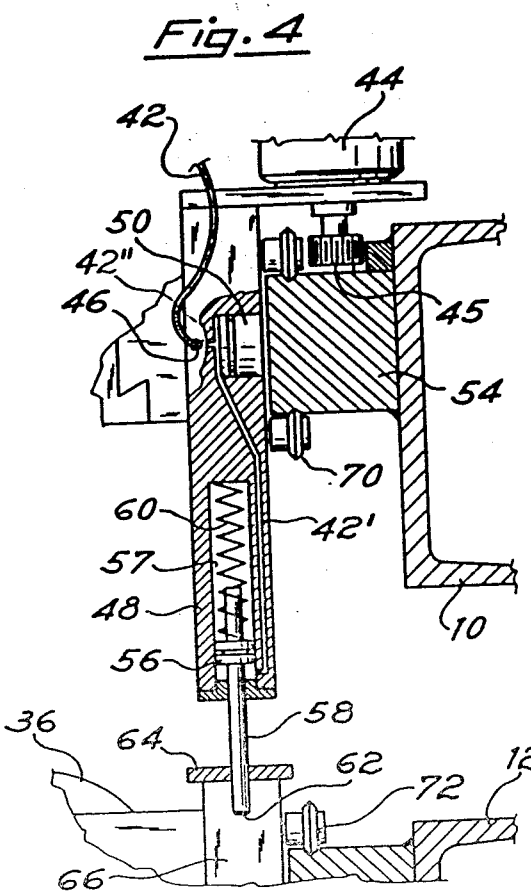
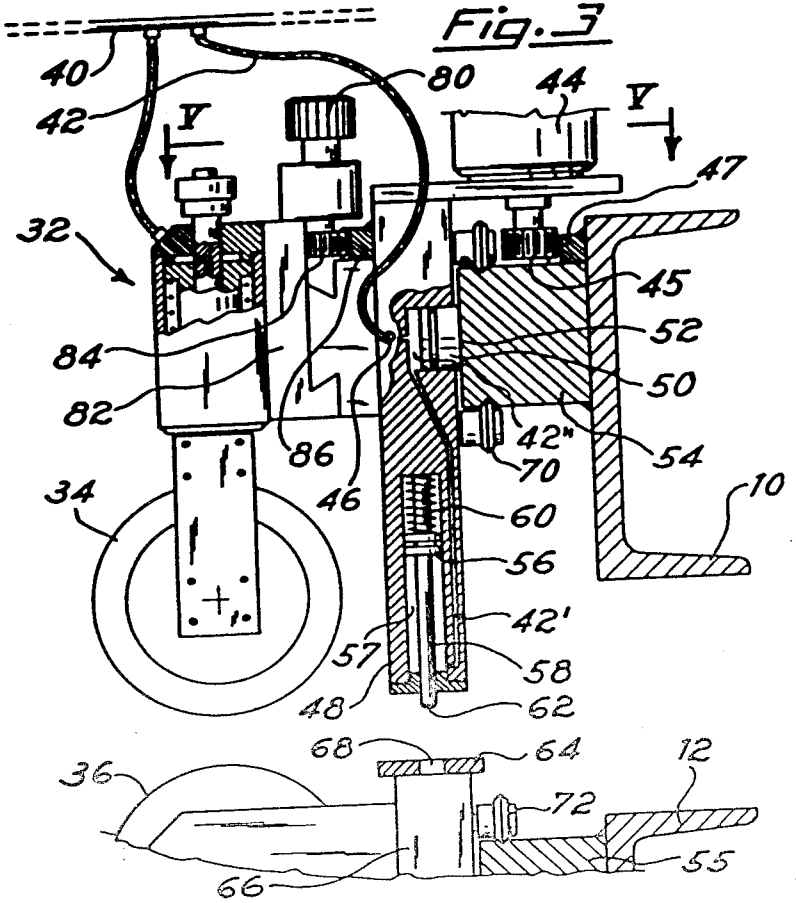

CUTTING UNITS FOR CUTTING MATERIAL IN BANDS INTO STRIPS

BACKGROUND OF THE INVENTION

1. Field of the Invention

The present invention refers in improvements made to cutting units for cutting bands of material into strips of a predetermined width.

More particularly, this invention refers to improvements made in cuttings units consisting of the combination of at least one rotating "blade" and a coherent "counter-blade" also usually rotating.

2. Description of the Prior Art

As is known; the cutting units of the type shown above are mainly, but not exclusively used in the paper industry, for the selective cutting of bands of material, generally paper based, of plastic material, as for example polystyrene or other artificial or synthetic polymeric porduct, or other manufactured article which can be cut into strips of a predetermined width.

The starting material is generally supplied in rolls by the manufacturing industry, or in the form of packages of different sizes and variously arranged.

It is also well-known that to reach efficient industrial production, it is necessary or at least economical, to have sevral cutting units available which must be selectively spaced along the length of a structure, generally known as a "beam", whose extremities are supported by "shoulders".

These spacings, obviously related to the dimensions of the starting material to be cut, are established and made with the process stopped, by means of the reciprocal engagement of the supports carrying said blade and counter-blade.

Generally this reciprocal engagement between the supports is ensured by at least one gudgeon fixed to the blade-carrying support which is inserted into a hole of the support, generally a plate, connected to the counter-blade.

In this way, by using a single motor means, the blade - counter-blade unit can be shifted. Several units can be connected to one or more beams and their simultaneous shift guarantees the correct constant spacing between the working surface.

The locking of the unit and the engagement of the blade with the counter-blade are generally done by means of pressurized fluid, generally compressed air, coming from a single source or supply "line", connected to a locking piston of the group on the beam and to an actuator respectively.

The pressurized sent into the actuator also preforms the operation of positioning the rotating blade in relation to the counter-blade. These cutting units are well-known and are widely used in industry, but long experience in the field has revealed that this technology, although technically valid, has some limitations and deficiencies. For example, the locking of the unit and the gudgeon control for the reciprocal engagement of the blade and counter-blade supports, require separate supplies of pressurized liquid and, given the number of the groups, this means considerable complexity of pipes and consequent production and maintenance costs, bulk, etc. Another disadvantage which the known cutting units have is the inevitable phenomenon of wear on the counter-blade, which involves continuous and laborious adjustment each time the unit is shifted.

SUMMARY OF THE INVENTION

The object of this invention is to solve the above problems.

More particularly, the object of this invention is to improve the cutting groups so that the above disadvantages do not take place. It has now been discovered that these and other purposes are achieved by providing each cutting unit with a system (means) driven by pressurized fluid, which enables one of the following combinations of operations to be effected alternatively: (1) locking the blade-carrying support on the beam and in synchronism, (2) operate the gudgeon so as to release the counter-blade support from the blade-carrying one; or (3) unlock the blade-carrying support and in synchronism, operate the gudgeon so as to connect the counter-blade support to the blade support.

In particular, by means of pressurized fluid, the breaking and locking of the blade-carrying support on the beam is effected and simultaneously, the counter-blade plate support gudgeon is released so that the process can begin. When the pressurized fluid supply is suspended, the blade support is unlocked and elastic means, such as a compression spring, forces the gudgeon to engage in the plate support so as to enable, with the help of motor power, the blade unit to be shifted as a unit along the stationary beams.

Another improvement, forming an integral part of the present invention, consists of the micrometric adjustment of the position of the blade in relation to the counter-blade, by shifting the blade micrometrically in relation to the counter-blade using a knob or equivalent means of gripping, which engages on a linear toothing or rack. The present invention also provides an improvement concerning the structure of the counter-blade. The improved structure of the counter-blade of the present invention enables compensation to be obtained, or better, the maintenance of the space of the optimum distance between the blade and the counter-blade so as to eliminate the need for many laborious adjustments.

BRIEF DESCRIPTION OF THE DRAWINGS

For the better understanding of the constructional and functional characteristics of the improved cutting units, the subject of the present invention, these will afterwards be explained in greater detail with the aid of drawings which represent a preferred arrangement which is illustrative but not limitative and in which:

FIG. 3 represents a schematic view, in partial section, of an improved cutting unit in the position of the blade locked against the beam and the gudgeon disconnected from the plate connected to the counter-blade;

FIG. 4 represents the schematic view of a detail of the unit in FIG. 3, in the position of the blade unlocked from the beam and the gudgeon connected to the plate of the counter-blade so that the group as a whole and a unit is free to move along the respective beams;

DESCRIPTION OF THE PREFERRED EMBODIMENTS

Figure 1:
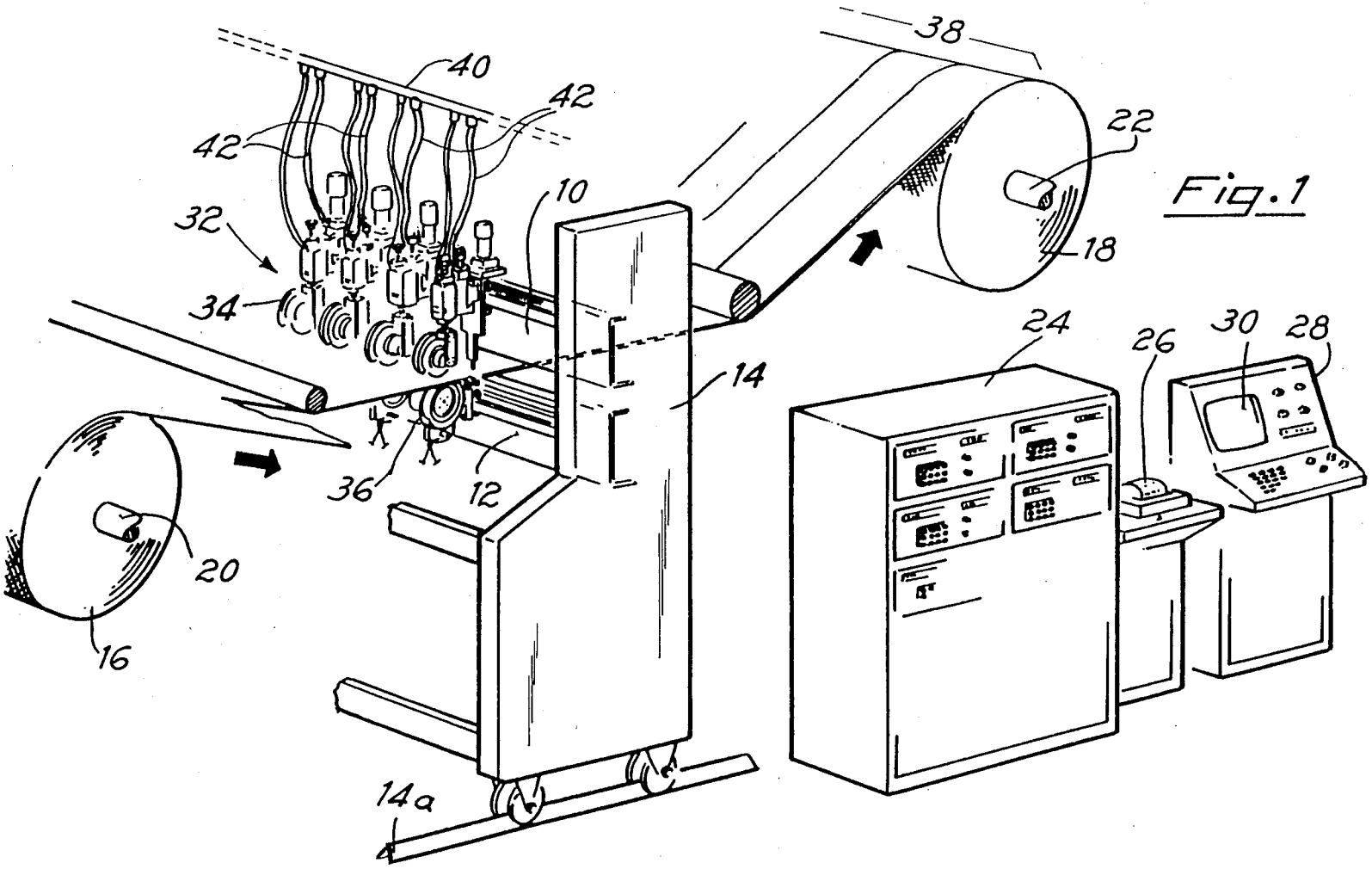
FIG. 1 represents the front perspective view of a machine for cutting bands of material into strips, comprising several cutting units and the operation command and reading switchboards.

With particular reference to the illustrations in the enclosed drawings and in particular to FIG. 1, the machine for cutting bands of material into strips comprises an upper beam 10 and a lower beam 12 fastened rigidly to the shoulder 14 (only one of which is represented) and which can be slid along the stationary guides 14*a*.

The machine is supplied with material, preferably paper-based, which is unwound from one supply roll 16 and is rewound onto a co-ordinated roll 18, after having been divided into strips 38, of a suitable predetermined width by means of several cutting units 32. The direction of movement is indicated by the arrows. In FIG. 1, part of the shafts 20 and 22 can be seen which support rolls 16 and respectively 18 of said material, and other details and structural and operative particulars which are omitted from the present invention because they are easily understood by experts in the field and do not constitute a characteristic of the invention and are already known from previous publications. FIG. 1 also reproduces, without specifying details, the systems of switchboard or command 24, checking 26 and manipulation 28 with reader 30.

Each cutting unit 32 comprises at least one "circular blade"34 and a "counter-blade" 36 for cutting the material coming from the roll 16 into strips 38.

The units 32 are supported in a movable and adjustable way on the beams 10 and 12 and supplied with air or other pressurized fluid along a primary line 40 from which extend several tubular pipes 42 for supplying the various locking and unlocking means of the blade 34 and the counter-blade 36.

Figure 2:
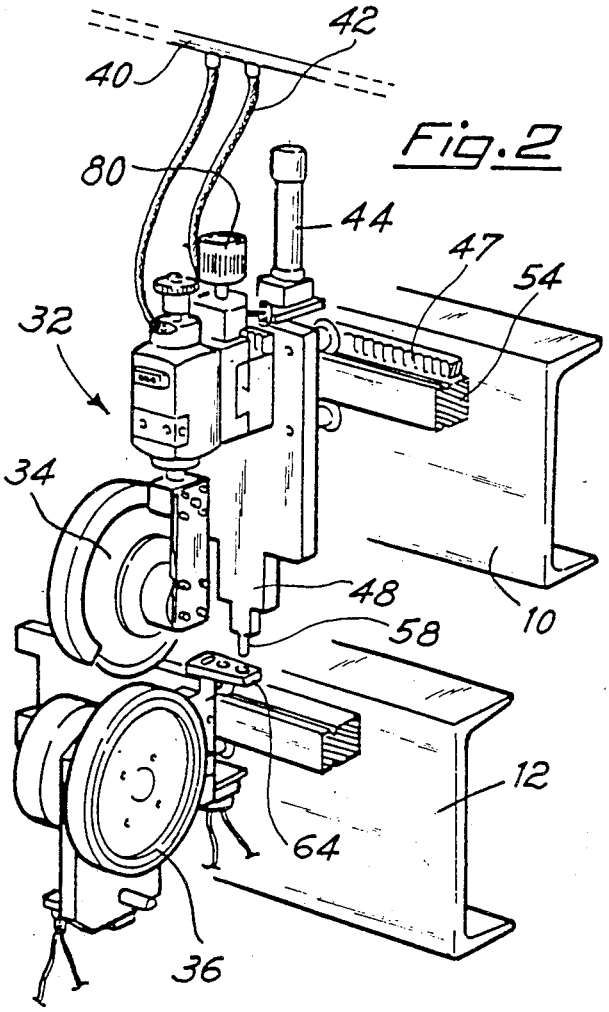
FIG. 2 represents the perspective view of one of the improved cutting units, the subject of the present invention.

With reference to FIG. 2, each cutting unit 32, comprising the "circular blade" 34 and the counter-blade 36, is connected by means of the tube 42 to the primary line 40 of pressurized fluid, particularly air.

Each of units 32 can be slid along the beam 10 and 12, with the help of respective motor means 44 controlled by the command systems 24 in a known way.

With reference to FIGS. 3 and 4, the blade 34 is supported by a support 48. The support 48 is provided with a cylindrical lateral housing 42″ to correspond to the beam 10, and in which a piston 50 slides, and the pipe 42′ cut lengthwise into the same thickness of the support and which comes out in the lower part of a cylindrical housing 57 in which the piston 56 moves, provided with a gudgeon 58. An elastic medium or a spring 60, placed between the piston 56 and the upper surface surface of the housing 57, pushes the gudgeon 58 downwards.

As FIG. 3 illustrates in detail, pressurized fluid fed to each tube 42, it spreads into the cylindrical housing 42″ through a regulation valve of a known type 46 and activates the piston 50 which locks the support 48 in 52 against an element 54 united to the beam 10 and therefore also locking the translation of the blade 34.

The same pressurized fluid (compressed air), upstream of the adjustment valve 46, flows into tube 42′ to activate the piston 56 which, in contrast to the elastic medium or spring 60, raises the gudgeon 58, releasing its extremity 62 from the corresponding hold 68 of a pierced plate 64 joined to the support 66 of the relative counter-blade 36.

In this position the blade 34 can be made to descend using known mechanical and pneumatic means, until it corresponds to said counter-blade 36, and then cuts the bands of material.

When the supply of pressurized fluid is suspended, the spring 60 pushes the gudgeon 58 downwards and inserts the extremity 62 into a corresponding hole 68 in the plate 64. In this way the blade is connected to the counter-blade. Simultaneously, the piston 50 is turned off so that support 48 is unlocked from the element 54, as illustrated in FIG. 4.

Under these conditions, by turning on the motor 44, onto which is splined the pinion 45 which is engaged with the rack 47 united to the beam 10, it is possible to slide the unit 32 along the respective beams 10 and 12 to get it into position.

This sliding is guided by rollers 70, united to support 48 and respectively by rollers 72, united to support 66. These run in guide rails placed on the respective stationary elements 54 and 55. Therefore the supply of the pressurized fluid coming from the pipe 42 and upstream of the valve 46, causes, simultaneously with the locking of the blade 34 under the action of the piston 50, the release of the gudgeon 58, under the action of the piston. This permits a new positioning of the blade 34 in relation to the counter-blade 36, under start of processing conditions.

Figure 6:
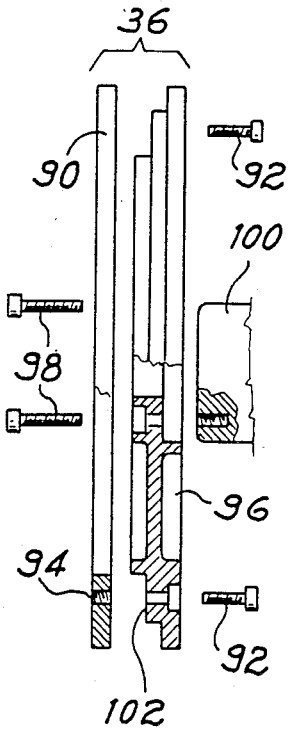
FIG. 6 is an "exploded" view (with components disconnected and partially sectioned) or the composite structure including the counter-blade.
Figure 7:
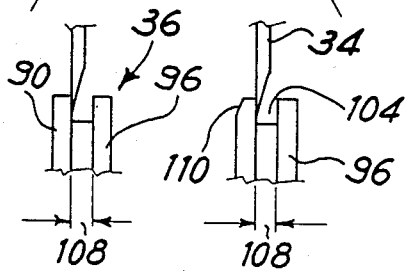
FIG. 7 represents some details concerning the possibility of reversing the relative positioning between the components of the counter-blade without the need for separate adjustment.
Figure 5:
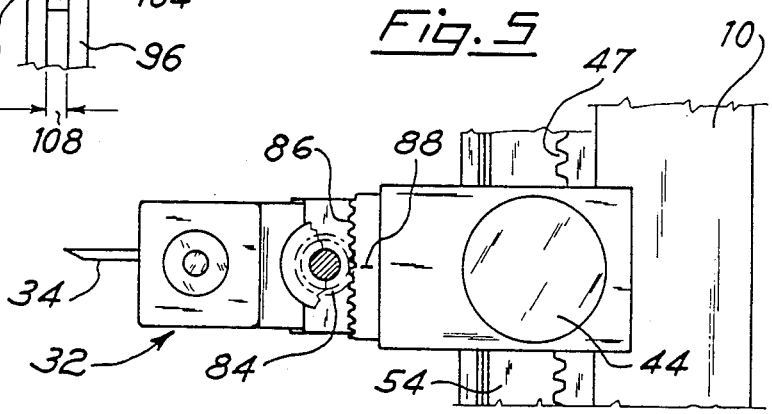
FIG. 5 represents the schematic and detailed view of a section taken on the plane and in the directions indicated by V—V in FIG. 3.

In this way it is obvious that using a single compressed air supply, it is possible to lock the blade 34 and release the counter-blade 36 and vice versa in snychronism. A further improvement concerns the micrometric adjustment of the blade 34 in relation to the counter-blade 36. This is done by moving a knob 80, carried by the limited translation slide 82. This knob 80 is connected to a toothed pinion 84 which works with a rectilinear toothing 86 fixed to the support 48. The rotation in one direction or the other of knob 80 therefore causes a micrometric shift of the blade 34 in relation to the counter-blade 36. This shift in position can be decided, for example, by comparing with a reference mark 88 preset on a graduated scale (FIG. 5). A further improvement covered by the present invention concerns the composite structure of the counter-blade 36, as can be seen in FIGS. 6 and 7.

As can be observed from these figures, the counter-blade 36 consists of a positioning element 90 which is fixed, in such a way that it can be removed (e.g. by means of screws 92 which go into threaded holes 94), to a second related element 96.

The counter-blade 36, consisting of the two elements 90 and 96 fixed together, is joined by means of screws 98, to a boss 100 joined to the support 66.

The element 96 is shaped so that is presents the centrepiece 102 in such a way that the combination of the elements 90 and 96 leads to the formation of a groove 104. Its width is predetermined and constant and such that the reversal of the position of element 90 does not change the width 108 of groove 104. It is evident that the inevitable wear on the element 90, wear deliberately exaggerated in FIG. 7 and indicated by 110, by the blade 34, can be cancelled by reversing element 90. This is because the certrepiece 102 ensures that the width 108 of the groove 104 remains. In this way laborious further adjustments and regulations between blade and counter-blade are avoided.

While the present invention has been described with reference to the figures which represent a preferred realization, they are to be considered illustrative but not limitative. Modifications, variations and changes can be made to these realizations within the spirit of the present invention and without exceeding its scope.

What is claimed is:

1. In a cutting device for cutting a band of material into strips of predetermined width comprising a frame which has an upper beam (10) and a lower beam (12), first roller means (16) for feeding said band of material and second roller means (18) for withdrawing the strips of said material, and several cutting units for dividing said band into strips of predetermined width, the improvement wherein each cutting unit comprises a first support (48) carrying a rotatable blade (34) which is translatable along said upper beam, a second support (66) carrying a rotatable counterblade (36), which is translatable along said lower beam, said first support being slidably secured to said upper beam, a gudgeon (58) for selectively fixing said first support said second support, motor means for moving said blades along said upper and lower beams, means for locking and unlocking said first support carrying said rotatable blade to said upper beam and, in synchronism, for disconnecting said second support carrying said counter-blade from said first support, said means comprising a single pressurized fluid tube (40, 42), a pair of pistons (50, 56) driven by said pressurized fluid, one of said pistons being operable to fix said first support to said upper beam and the other piston being operable to fix the gudgeon of the first support to the second support, said pressurized fluid being fed to locking and unlocking means of said first support and said blade and said counter blade means to lock and unlock said second support and performing one of the following combinations of operations alternately; locking the first support carrying said blade to said upper beams and in synchronism, operating the gudgeon so as to disconnect the second support carrying the counter-blade from the first support, and unlocking the first support carrying the blade and in synchronism operating the gudgeon so as to connect the second support.

2. The device according to claim 1 wherein said first support (48) carrying the blade is provided with a lateral cylindrical housing (42''), said one of said pistons (50) being slidable in said lateral cylindrical housing and with a pipe (42') cut lengthwise into the thickness of said first support, said pipe (42') extending in the lower part of a vertical second cylindrical housing (57) formed in said first support, said other piston (56) moving in said second cylindrical housing, spring means (60) biasing said gudgeon downwardly in thrust with said other piston, said pressurized fluid being fed to said lateral cylindrical housing (42'') and said pipe (42') and actuating said first piston, said spring means being located between said other piston and the upper surface of said second cylindrical housing.

3. The device according to claim 1 wherein the second support (66) is equipped with a pierced plate (64) having holes for engagement with the gudgeon.

4. The device according to claim 1 wherein said upper beam has fixed thereto an element (54), said piston (50) upon the action of said pressurized fluid locking said first support and locking said blade in position on said element (34).

5. The device according to claim 1 wherein said pressurized fluid flows into said tube (42') and actuates said second piston.

6. The device according to claim 1 wherein said first and second support are provided with rollers (70, 72) which run along guide means on said beams.

7. The device according to claim 1 which includes a means for the micrometric adjustment of the position of the blade in relation to the counter-blade, comprising a knob connected to a movable slide and to a toothed pinion which works together with a rectilinear toothing fixed to the first support.

8. The device according to claim 1 wherein the counter blade includes two removably connected elements (90, 96), said two elements forming a groove therebetween.

9. The device according to claim 8 wherein the counter-blade (36) is united to a boss fixed to said second support.

* * * * *